United States Patent [19]

Long

[11] Patent Number: 4,903,364

[45] Date of Patent: Feb. 27, 1990

[54] CLEANING UNDERLYING SURFACES

[76] Inventor: Jerry T. Long, 11208 Cowlitz Dr. S.E., Olympia, Wash. 98503

[21] Appl. No.: 216,285

[22] Filed: Jul. 8, 1988

[51] Int. Cl.[4] ..... A47L 11/26

[52] U.S. Cl. ..... 15/50 R; 239/258; 239/754

[58] Field of Search ..... 15/50 R, 98; 239/253, 239/258, 587, 722, 754, 251

[56] References Cited

U.S. PATENT DOCUMENTS

| | | | |
|---|---|---|---|
| 2,883,116 | 4/1959 | Muench | 239/251 |
| 3,029,028 | 4/1962 | Skerritt | 239/251 |
| 3,748,050 | 7/1973 | Poppitz | 15/50 R X |
| 4,191,590 | 3/1980 | Sundheim | 15/50 R X |

*Primary Examiner*—Edward L. Roberts

*Attorney, Agent, or Firm*—Charles A. McClure

[57] ABSTRACT

Cleaning underlying surfaces, especially irregular surfaces, such as shake roofs, grooved pavements or ramps, and the like. Mobile apparatus under the guidance of an operator brushes the underlying surface and sprays water or other cleaning liquid onto it in a rotating pattern as the operator traverses the apparatus and, thus, the cleaning locus relative to the supporting surface. A "compass point" wheel arrangement enables the apparatus to be positioned with one wheel off the edge of the supporting surface to clean over the edge while maintaining three-point stability, whereas temporary removal of a wheel enables close approach to clean an intersection of the underlying supporting surface and an adjoining wall or other adjacent upright surface.

8 Claims, 3 Drawing Sheets

Fig. 1
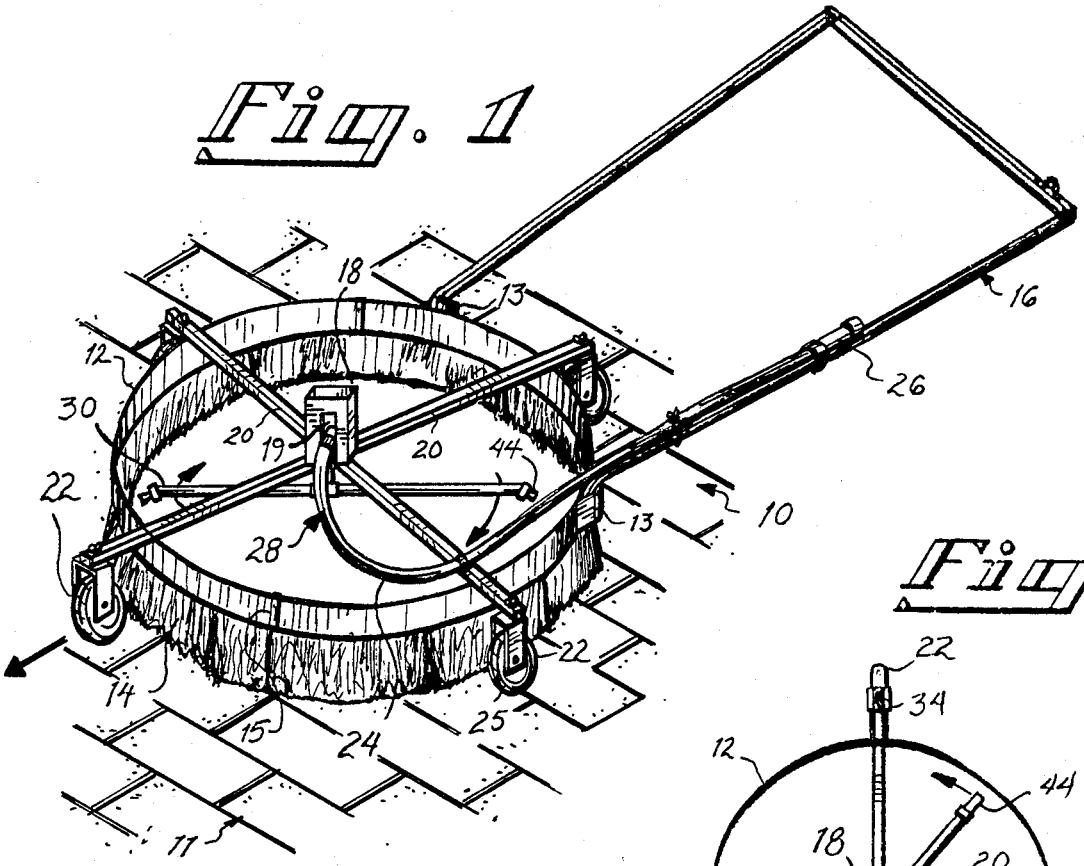
Fig. 2
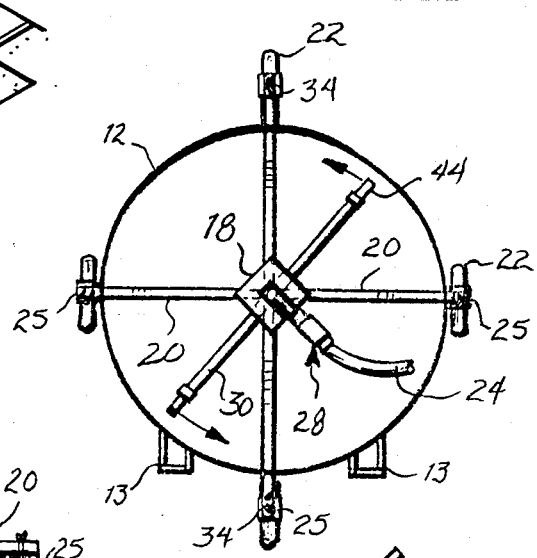
Fig. 3
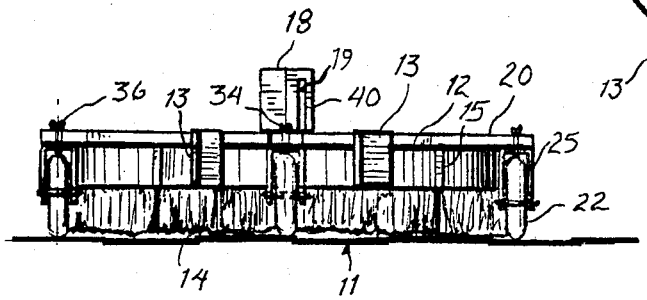
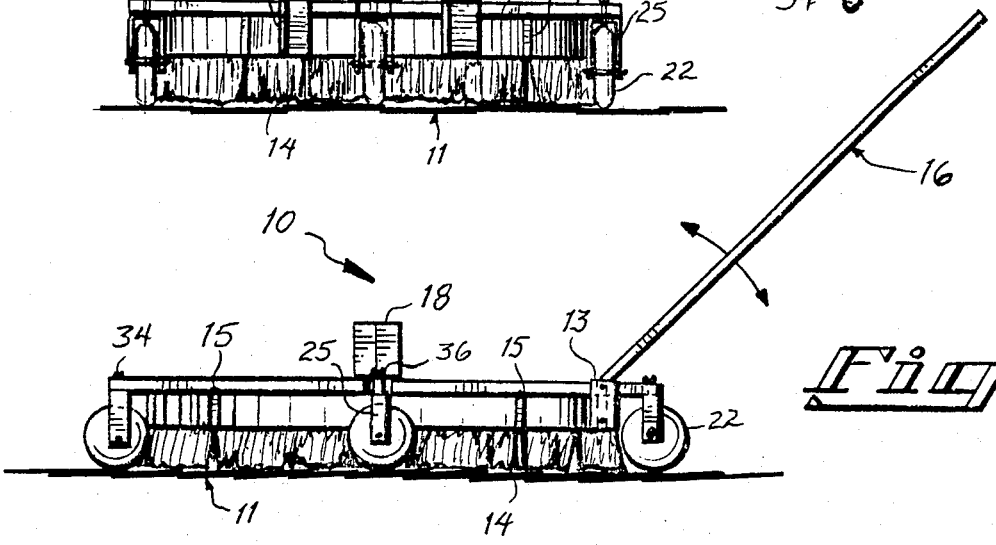
Fig. 4

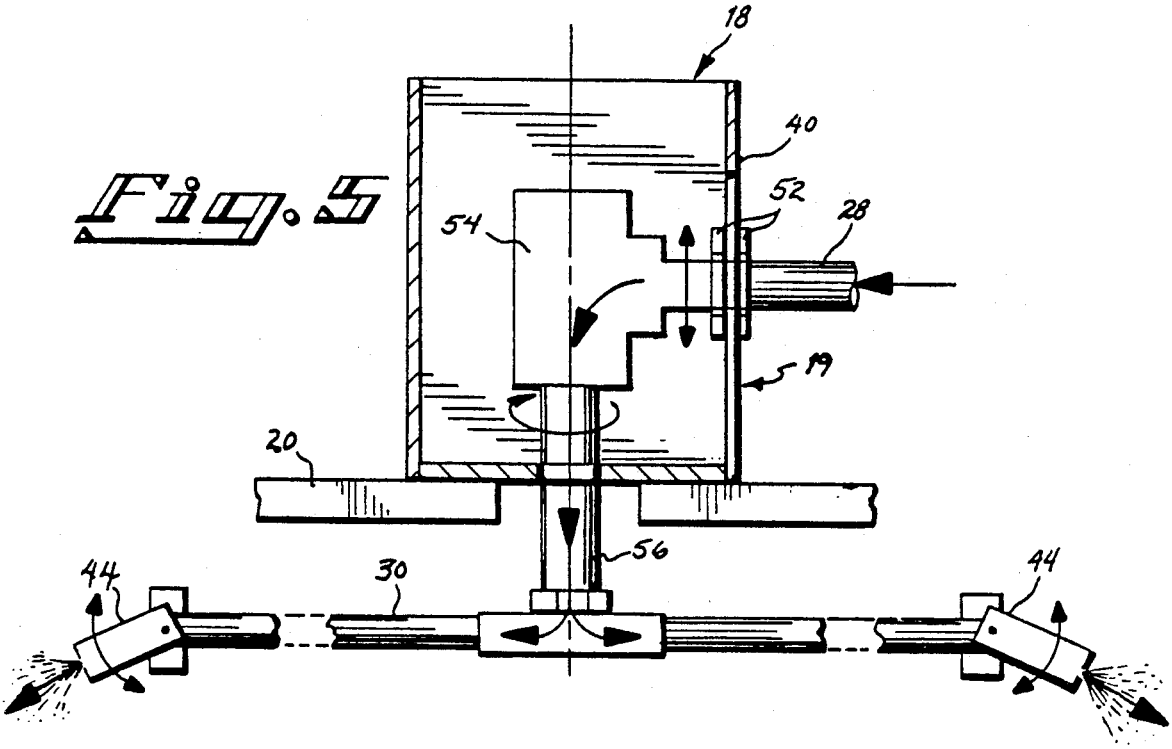
Fig. 5
Fig. 6
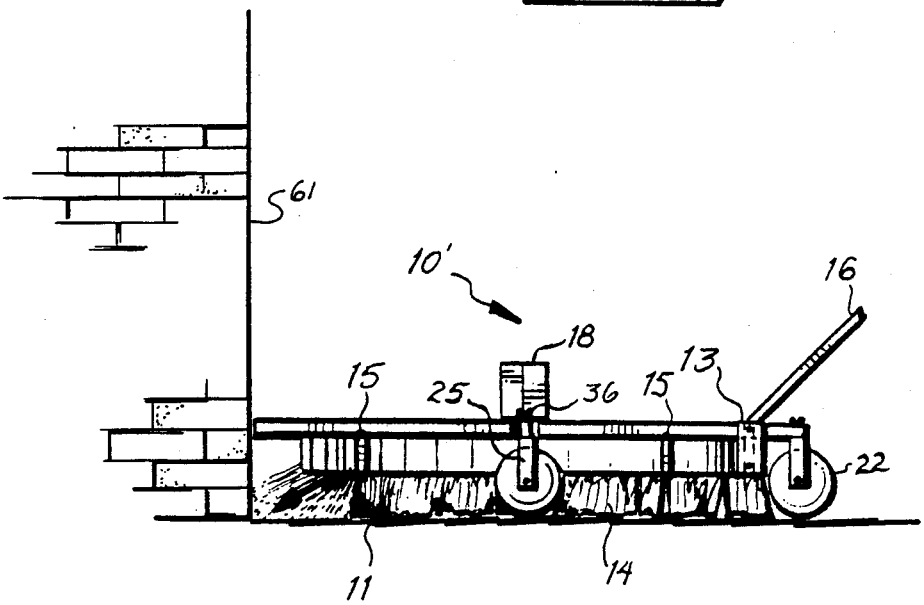

CLEANING UNDERLYING SURFACES

FIELD OF THE INVENTION

This invention relates to liquid cleaning of roofs, grooved pavements, or other uneven (or even) underlying surfaces, and concerns especially operator-controlled apparatus for doing so.

BACKGROUND OF THE INVENTION

Whereas flat smooth surfaces are generally relatively easy to clean by washing, regardless of orientation, uneven or otherwise irregular surfaces, especially if underfoot, are more difficult. Many displaced materials, plants, and even animals collect in the cracks, crevices, and interstices of roofs, grooved pavements, etc. Manual methods of washing or otherwise cleaning such surfaces are laborious, lengthy, and often not too satisfactory. Also footing is insecure on such surfaces, especially when appreciably inclined.

Machine-assisted methods of washing such surfaces are known, with rotary brushes, rim-fed as disclosed by Krause in U.S. Pat. No. 3,624,668 and alternatively center-fed as taught by Tissier in U.S. Pat. No. 4,000,538, or with jets and a vibrating tamper as disclosed by Conway in U.S. Pat. No. 3,711,891. However well such devices may work on carpets or flat surfaces, they leave much to be desired where unyielding irregularities collect dirt, grease, moss, seeds, etc., especially on sloping and/or terraced underlying surfaces, where my invention is particularly effective and meets a long-felt need.

SUMMARY OF THE INVENTION

In general, the objects of the present invention are attained by controlled repetitive multi-directional application of washing liquid, forcibly and periodically. More particularly, wash water is applied to an underlying surface to be cleaned, in centrifugal manner along a traverse path as controlled by a human operator.

Apparatus for practicing such procedure conveniently includes a plurality of water jets or sprays toward an underlying surface to be cleaned and supported rotatively apart from one another about an axis substantially perpendicular to such surface. The jet action preferably is bounded by fixed (i.e., non-revolving) but removable circumferential brushes traversable over and in nearly continuous contact with such underlying surface.

A primary object of the present invention is to improve the cleaning of irregular underlying surfaces.

Another object of this invention is to save labor and time in pressure washing of such underlying surfaces.

A further object of the invention is to provide new apparatus designed to perform such cleaning and washing of such surfaces.

Other objects of this invention, together with methods and means for attaining the various objects, will become apparent from the following description and the accompanying diagrams of one or more preferred apparatus embodiments, which are presented by way of example rather than limitation.

SUMMARY OF THE DRAWINGS

FIG. 1 is a perspective view of an embodiment of apparatus according to the present invention;

FIG. 2 is a plan view of such apparatus embodiment;

FIG. 3 is a fragmentary rear elevation of the same equipment;

FIG. 4 is a side elevation of the same apparatus;

FIG. 5 is a fragmentary side elevation of part of the same apparatus; and

FIG. 6 is a fragmentary side elevation of an apparatus embodiment modified according to this invention facing a wall rising from the roof it is on.

DETAILED DESCRIPTION

Figure 7:
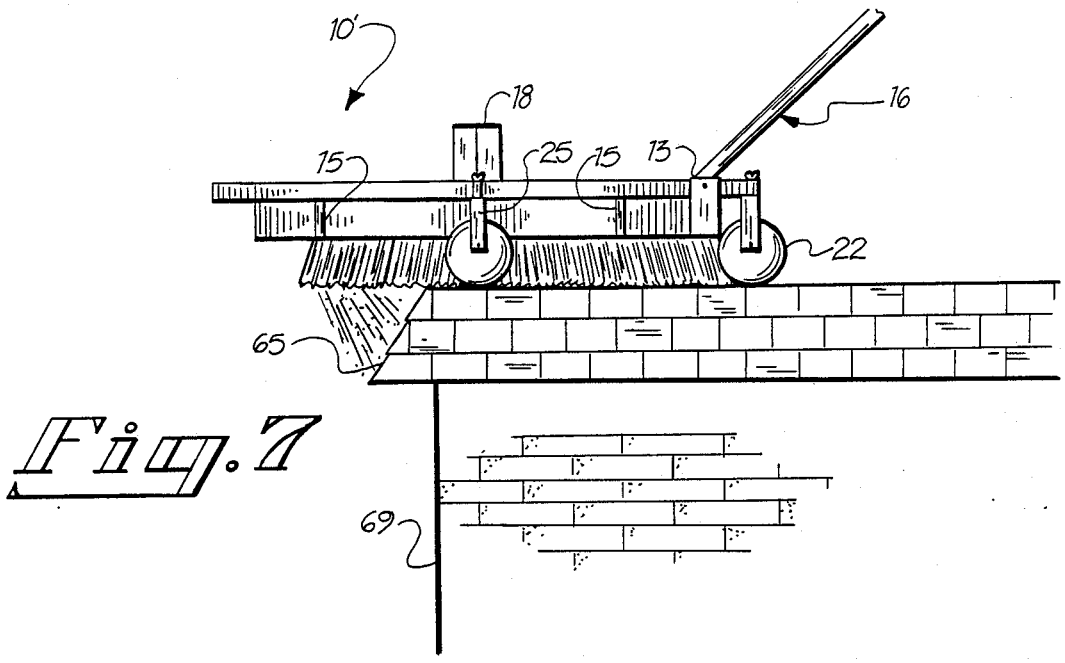
FIG. 7 is a fragmentary side elevation of the apparatus embodiment of FIG. 6 partly overhanging the edge of the roof and an underlying vertical wall.

FIG. 1 shows apparatus embodiment 10 of the present invention in perspective, FIG. 2 in plan, FIG. 3 in rear elevation, and FIG. 4 from the left side. A major "compass point" arrangement of wheels 22 supports four cross-frame members 20 affixed at their respective innermost ends to housing 18. Included are a rear wheel ("south") closest to operator's handle 16, a front wheel ("north") furthest forward, and two side ("east" and "west") wheels·22, each affixed by a yoke 25 via a fastener 34 to the outermost end of the adjacent cross member as carriage means for the other apparatus components.

So carried are circumferential shielding means having ringlike band 12 and skirtlike brushing means 14 held removably by fasteners 15 to the band, depending therefrom into contact with underlying surface 11. Handle 16 is affixed adjustably in height at each side of the rear of the band (opposite to arrow direction) by retaining means 13.

Featured in this first embodiment are a pair of rotatable (curved arrows) radial wands 30 carrying jet or spray heads 44 at their opposite ends. The wands depend from and are connected for water flow from vertically adjustable rotary joint 54, partially surrounded by housing 18, open at both top and bottom and affixed to the inner ends of the cross-frame members. The wands rotate in a horizontal plane at a level below the top, and above the bottom, edges of circumferential band 12. Hose adapter 26, with adjusting valve 27, is secured to one side of the handle to connect to an external source of pressurized water, and hose adapter 28 attaches to the side of rotary joint 54 after traversing vertical slot 19 (FIGS. 1, 3) in one side of housing 18.

FIG. 5 shows many of the latter members in greater detail, along with pair of lock nuts 52 gripping opposite faces of the side edges of slot 19 in wall 40 of housing 18 through which hose adapter 28 passes to join rotary joint 54. A double-ended vertical arrow indicates height adjustability of the supported members, notably rotatable vertical tube 56 depending from the rotary joint and in the flow path to oppositely directed pair of wands 30. Jet or spray tips 44 adjustable in angle (double-ended curved arrows) are mounted about generally horizontal pivots on the ends of the wands.

FIG. 6 shows, inside elevation, modified apparatus embodiment 10' of the present invention. Components corresponding to those of the previous embodiment (cf. FIG. 4) have reference numerals larger by one hundred than previously and being so readily identifiable are not necessarily mentioned further here. The most notable of the differences are that this modification has no front wheel, and its skirt 14 lacks the front quadrant while retaining the rear and both side quadrants. Wall 61 rising from underlying surface 11 is directly ahead of this modified apparatus embodiment, opposite the open skirt quadrant and thereby in position to be sprayed with water but not reachable with the skirt of brushing means.

Figure 8:
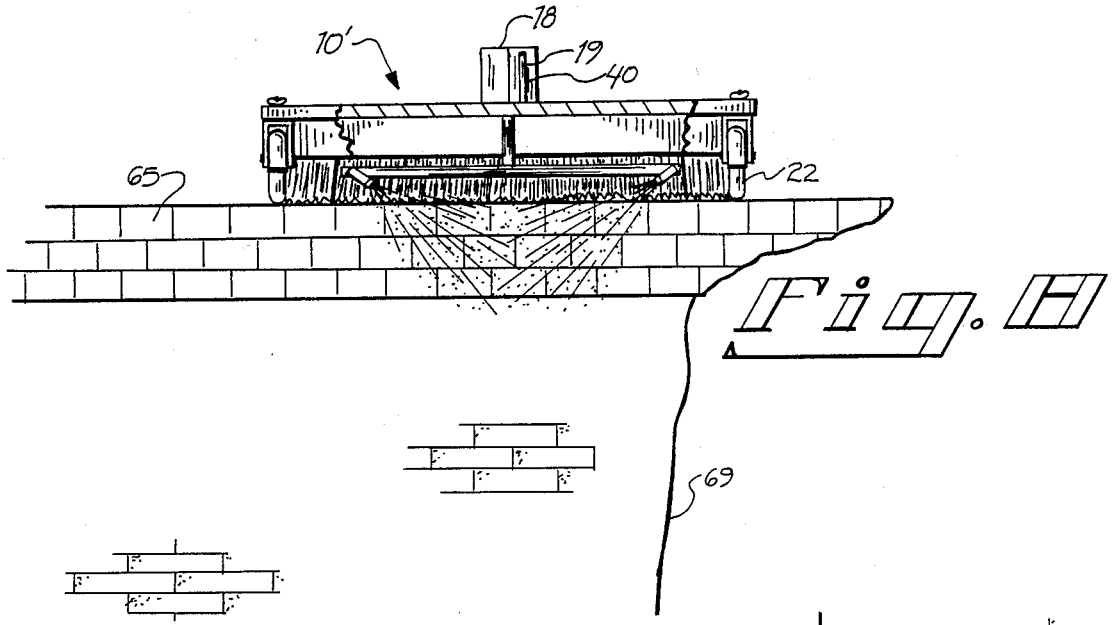
FIG. 8 is a fragmentary front elevation of the apparatus embodiment of FIGS. 6 and 7 partly overhanging the edge of the roof and an underlying vertical wall.

FIGS. 7 and 8 show sideways and head-on, respectively, apparatus 10' of FIG. 6 overhanging the edge of roof 11, cornice 65 and underlying wall 69. In the absence of the front quadrant of brushing skirt 14—unneeded because there is nothing underneath in that quadrant to brush in such position—the cleaning solution is directed back onto the cornice by proper setting of spray tips 44 to discharge partly radially inward (and downward) rather than outward (and downward), in accordance with their adjustability about a horizontal axis—already shown in FIG. 5.

Figure 9:
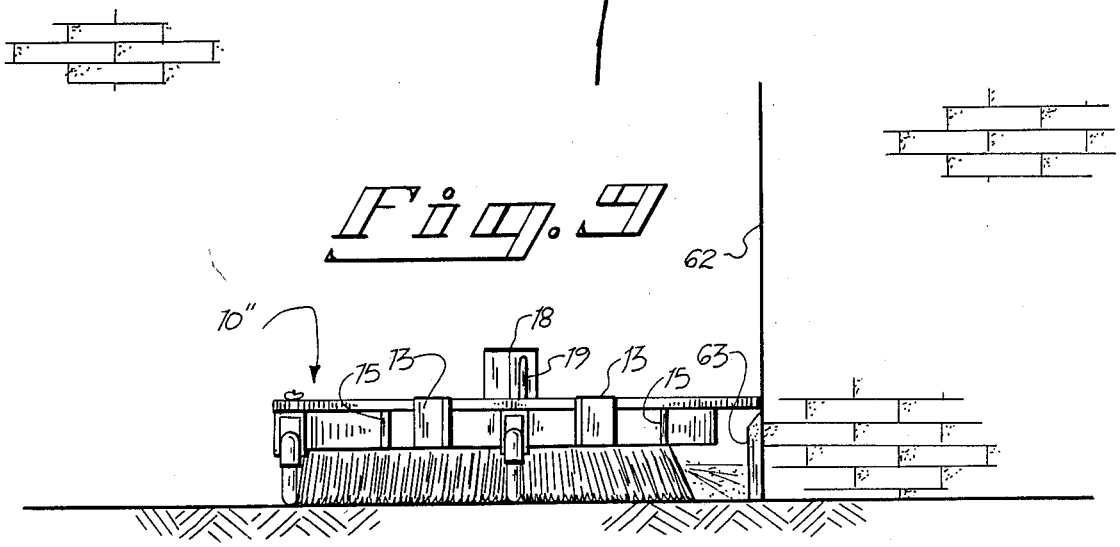
FIG. 9 is a fragmentary front elevation of an apparatus embodiment of the invention modified to abut sideways an edge of the roof with a wall rising upright from the roof.

FIG. 9 shows head-on apparatus 10" modified by removal of a side (rather than front) quadrant of the brushing skirt and the wheel on that side. Such modification enables the apparatus to be moved along the corner of the roof with rising slant wall 62 with bbaseboard 63 closer than permitted when the wheel is present, without sacrificing three-point stability. Of course, more conventional apparatus with wheels at the usual four corner locations, as on an automobile, cannot attain the same advantage.

It will be readily understood that, instead of (as in FIG. 5) lacking the front wheel in the compass-point wheel arrangement of this invention, either side wheel could be removed in like manner so long as the front and rear wheels remained in place to provide three-point support. Such modification would enable the operator to maneuver the apparatus close to—and thereby clean—an upright side wall. Similarly the brushing skirt could be removed at the wall side to enable the cleaning liquid to reach the junction of such wall with the underlying surface supporting the apparatus. (See FIG. 9.)

The operation of the apparatus of this invention is readily understood. The operator positions it on an underlying surface to be cleaned and connects a pressurized water supply hose to the hose adapter on the handle. A cleaning solution may be added to the water source or may be fed into the water from a metering supply container (not shown). With the spray tips adjusted for a desired angle of incidence upon the underlying surface, the operator opens the hose valve, whereupon the wands begin to rotate as liquid jets from their tips. The operator then maneuvers the apparatus over the surface as desired. It also will be apparent that the liquid may be turned off temporarily in order to brush the surface before or after wetting it. If at first the cleaning action is inadequate (or excessive) the operator may readjust the spray tips or adjust the height of the spray wands relative to the underlying surface.

The operator advances the apparatus gradually, thus continually varying the locus of impact of the water or cleaning solution on the underlying surface and thus compensating for roughness or other irregularity thereof normally difficult to clean. If the surface being cleaned is bounded by an upstanding wall or similar surface, the modification without a wheel (and some of the brushing skirt) at the most closely adjacent quadrant of the apparatus enables the operator to maneuver so as to get close enough to such surface to clean it well. Up to about two quadrants of the brushing means may be omitted or removed at will, but only the wheel of one quadrant, of course.

At a free edge of the underlying surface, either embodiment, with or without its otherwise overhanging wheel removed, enables the operator to extend the carriage partly out over the edge to ensure that the outer part of the edge gets cleaned. The apparatus is so light that it is easily maneuverable and readily handled on roofs with moderate slopes and on ramps and similar inclines to be cleaned.

Preferred embodiments of the apparatus of this invention have been shown and described. Other modifications may be made, as by adding, combining, deleting, or subdividing parts or steps, while retaining at least some of the advantages and benefits of this invention, which itself is defined in the following claims.

The claimed invention is:

1. Mobile apparatus for cleaning an underlying surface and optionally other adjacent surfaces, comprising
- spraying means adapted to rotate in a given plane for dispensing cleaning liquid,
  - having a plurality of spray tips at spaced intervals;
- circumferential shielding means for the rotating spray means,
  - including completely circumferential brushing means; and
- carriage means movably supporting the foregoing means on the underlying surface,
  - having supporting wheels normally in contact with the underlying surface;
- wherein the spray tips are adjustable in position about horizontal pivots tangential to the plane of rotation and arranged at even circumferential intervals on supporting wands rotatable in such plane.

2. Mobile cleaning apparatus according to claim 1, wherein the wands are adjustable in height relative to the underlying surface.

3. Mobile apparatus for cleaning an underlying surface, comprising
- horizontally rotating means for dispensing cleaning liquid, including a hollow rotary joint carrying a plurality of radial spray arms interconnected thereto to receive liquid therefrom,
- circumferential shielding means for the rotating means, including a ringlike band around the rotational path traced by the outer extremities of the rotating means, and a skirt of brushing means variable from completely to incompletely circumferential depending therefrom into contact with the underlying surface,
- carriage means including a frame, handle means affixed to the frame, and a plurality of supporting wheels normally in contact with the underlying surface and movably supporting the foregoing.

4. Mobile cleaning apparatus according to claim 3, including
- a rear wheel location closest to the handle,
- a front wheel location furthest from the handle, and
- a pair of side wheel locations flanking the circumferential means.

5. Mobile cleaning apparatus according to claim 4, wherein the front and side wheels are individually removable.

6. Mobile cleaning apparatus according to claim 3, wherein the skirt of brushing means extends around the rear quadrant and at least one of the side quadrants of the circumferential means.

7. Mobile cleaning apparatus according to claim 6, wherein the skirt of brushing means extends around substantially all four quadrants of the circumferential means.

8. In mobile apparatus for cleaning an underlying surface, including spray means for dispensing cleaning liquid while rotating in a given plane, and carriage means for supporting such means movably on such surface; the improvement comprising circumferential shielding means limiting the spray extent and including a plurality of substantially non-semicircular circumferential brushing segments, selectively removable to enlarge the spray extent in desired directions, wherein there are at least four such segments, at least three of which are so removable.

* * * * *